US012421825B2

(12) United States Patent
Dudzinski et al.

(10) Patent No.: US 12,421,825 B2
(45) Date of Patent: Sep. 23, 2025

(54) FRACKING PLUG WITH A SUPPORT RING

(71) Applicant: Parker-Hannifin Corporation, Cleveland, OH (US)

(72) Inventors: Paul A. Dudzinski, Meriden, CT (US); Kenneth W. Cornett, Madison, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 18/780,943

(22) Filed: Jul. 23, 2024

(65) Prior Publication Data

US 2025/0163773 A1 May 22, 2025

Related U.S. Application Data

(60) Provisional application No. 63/601,329, filed on Nov. 21, 2023.

(51) Int. Cl.
*E21B 33/129* (2006.01)

(52) U.S. Cl.
CPC ..... *E21B 33/1293* (2013.01)

(58) Field of Classification Search
CPC ..... E21B 33/1293; E21B 43/261
See application file for complete search history.

(56) References Cited

U.S. PATENT DOCUMENTS 3,011,806 A * 12/1961 Allen ..... F16L 39/005 285/123.8
2013/0112398 A1 5/2013 White
2013/0269929 A1 10/2013 Smith
2014/0020911 A1 1/2014 Martinez
2020/0347694 A1* 11/2020 Power ..... E21B 33/129
2020/0370392 A1* 11/2020 Jordan, Jr. ..... E21B 33/1216
2021/0087902 A1 3/2021 Saeed
2023/0243233 A1* 8/2023 Slup ..... E21B 23/00 166/135
2024/0287867 A1* 8/2024 Patsy ..... E21B 33/128

OTHER PUBLICATIONS

WO2019023493 (Year: 2019).*
Steelhaus, "Reacxion Complete Fully Dissolvable Frac Plug", retrieved from the Internet at: https://steelhausinc.com/product/fully_dissolvable_frac-plug/ on Sep. 26, 2023.

* cited by examiner

*Primary Examiner* — Cathleen R Hutchins
(74) *Attorney, Agent, or Firm* — McDonnell Boehnen Hulbert & Berghoff LLP

(57) ABSTRACT

An example plug assembly includes: a cone; a seal mounted to the cone; an anchoring ring comprising a plurality of anchoring ring segments disposed in a circular array, wherein a respective receptacle is formed between each two adjacent anchoring ring segments of the plurality of anchoring ring segments; and a support ring that is interposed between the seal and the anchoring ring, wherein the support ring comprises a plurality of support ring segments disposed in a respective circular array, such that each support ring segment partially overlaps two adjacent anchoring ring segments, and wherein each support ring segment of at least a subset of the plurality of support ring segments has a protrusion that is received within the respective receptacle.

20 Claims, 5 Drawing Sheets

FRACKING PLUG WITH A SUPPORT RING

CROSS REFERENCE TO RELATED APPLICATION

The present application claims priority to U.S. Provisional Application No. 63/601,329 filed on Nov. 21, 2023, the entire contents of which are herein incorporated by reference as if fully set forth in this description.

BACKGROUND

Fracking is a well stimulation technique that involves the fracturing of formations in bedrock by a pressurized liquid. The process involves the high-pressure injection of "fracking fluid" into a wellbore to create cracks in the deep-rock formations through which natural gas, petroleum, and brine can flow more freely.

In fracking applications, a plug can be used to seal and isolate certain portions of a drilled well from other portions of the well. A sealing plug that fully isolates one well portion (e.g., a downstream or down hole portion) from another well portion (e.g., an upstream or up hole portion), wholly blocking flow between the two portions, can be referred to as a bridge plug. Other types of plugs may allow flow in a particular direction (e.g., downstream), but block flow in other directions (e.g., upstream). Plug seals may be permanent, or may be nonpermanent dissolving or otherwise removable plugs.

For example, a bridge plug may be located within a well casing to isolate a downstream portion of a well from an upstream portion of the well. In the upstream portion, the well casing may include a plurality of transverse holes that open into a surrounding rock formation. In the hydraulic fracturing process, pressurized fluid is pumped down into the well. At the bridge plug, flow of such fluid is blocked from proceeding from the upstream portion to the downstream portion, thereby causing the upstream portion of the well to be pressurized the well. Under such pressure, the fluid is forced through holes in the upstream well casing into the adjacent rock formation. The pressurized flow into the rock formation in turn creates cracks through which oil and gas may be extracted.

The plug is typically conveyed through the well casing (steel tubing) over long distances to reach a targeted isolation point within the well. Plugs can be pushed down the well by high volumes of water under pressure. The velocity of the water passing the plug can impart loads on the components within the plug and possibly dislodge the components. This would lead to the plug failing to function properly. In other cases, a 'pre-set' condition may occur, where the plug is prematurely bound up in the well casing prior to reaching a desired location (isolation point), thus requiring costly remedial work to remove it. As such, it may be desirable to maintain components of a plug locked within a plug assembly during conveyance of the plug to a desired location to prevent dislodgement while traveling along the well casing.

Further, the plug may include segmented components that allow for unrestricted expansion during activation (e.g., setting the plug at a particular location within the well casing). As such, gaps form between the segments as they expand. Under high fluid pressure, seals can be extruded through such gaps, leading to failure of the plug. It may thus be desirable to configure the plug assembly in a manner that prevents such seal extrusion from occurring.

It is with respect to these and other considerations that the disclosure made herein is presented.

SUMMARY

The present disclosure describes implementations that relate to a fracking plug with a support ring.

In a first example implementation, this disclosure describes a plug assembly including: a cone; a seal mounted to the cone; an anchoring ring comprising a plurality of anchoring ring segments disposed in a circular array, wherein a respective pocket is formed between each two adjacent anchoring ring segments of the plurality of anchoring ring segments; and a support ring that is interposed between the seal and the anchoring ring, wherein the support ring comprises a plurality of support ring segments disposed in a respective circular array, such that each support ring segment partially overlaps two adjacent anchoring ring segments, and wherein each support ring segment of at least a subset of the plurality of support ring segments has a protrusion that is received within the respective pocket.

In a second example implementation, this disclosure describes a method of deploying the plug assembly of the first example implementation in a tube.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Within examples, disclosed herein are plug assemblies involving a segmented support ring interposed between a seal and a segmented anchoring ring. During conveyance of the plug assembly to a particular location within a tube (e.g., a well casing) using fluid (e.g., large volumes of water under pressure), the seal, the support ring, and the anchoring ring remain engaged and aligned to prevent dislodgement of the components. Further, when the plug assembly is activated at the particular location, where segments of the anchoring ring are expanded, respective segments of the support ring bridge respective gaps formed between expanded segments of the anchoring ring to prevent extrusion of the seal through the gaps during activation of the plug assembly.

Figure 1:
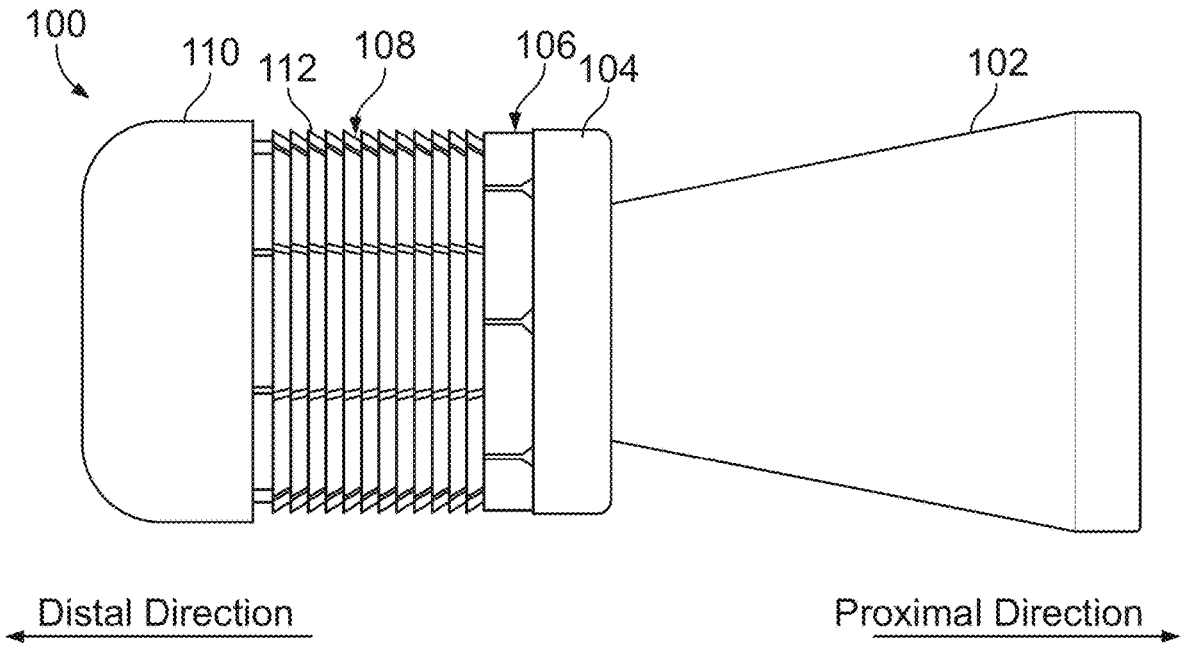
FIG. 1 illustrates a side view of a plug assembly, according to an example implementation.

FIG. 1 illustrates a side view of a plug assembly 100, according to an example implementation. The plug assembly 100 is configured to be deployed at a particular location within a tube (e.g., a well casing). Deployment of the plug assembly 100 include a conveyance phase, or where the plug assembly 100 is pushed (e.g., via fluid such as water) to a particular location. Deployment then includes an activation phase once the plug assembly 100 reaches the particular location. In the activation phase, some of the components of the plug assembly 100 are expanded via a tool to be anchored in position to the interior surface of the tube to seal an upstream portion of the tube from a downstream portion of the tube.

The plug assembly 100 includes a cone 102, a seal 104, a support ring 106, and an anchoring ring 108. The support ring 106 is interposed between the seal 104 and the anchoring ring 108 as depicted in FIG. 1.

As described below with respect to FIG. 2, the anchoring ring 108 is segmented. During conveyance of the plug assembly 100 through the tube, the outer diameter of the anchoring ring 108 is smaller than an inner diameter of the tube.

In examples, segments of the anchoring ring 108 are locked or retained in place via frangible retention features. For instance, the segments can be bonded in place using an adhesive that can break under a force applied to expand the segments radially outward.

In another example, a bushing or end plate 110 is mounted at a distal end of the anchoring ring 108 to keep the segments together. The end plate 110 can be bonded (e.g., via an adhesive) to the anchoring ring 108, for example. The end plate 110 is configured as a frangible retainer that fractures or shears at a defined load to allow the segments to expand during activation of the plug assembly 100.

Figure 2:
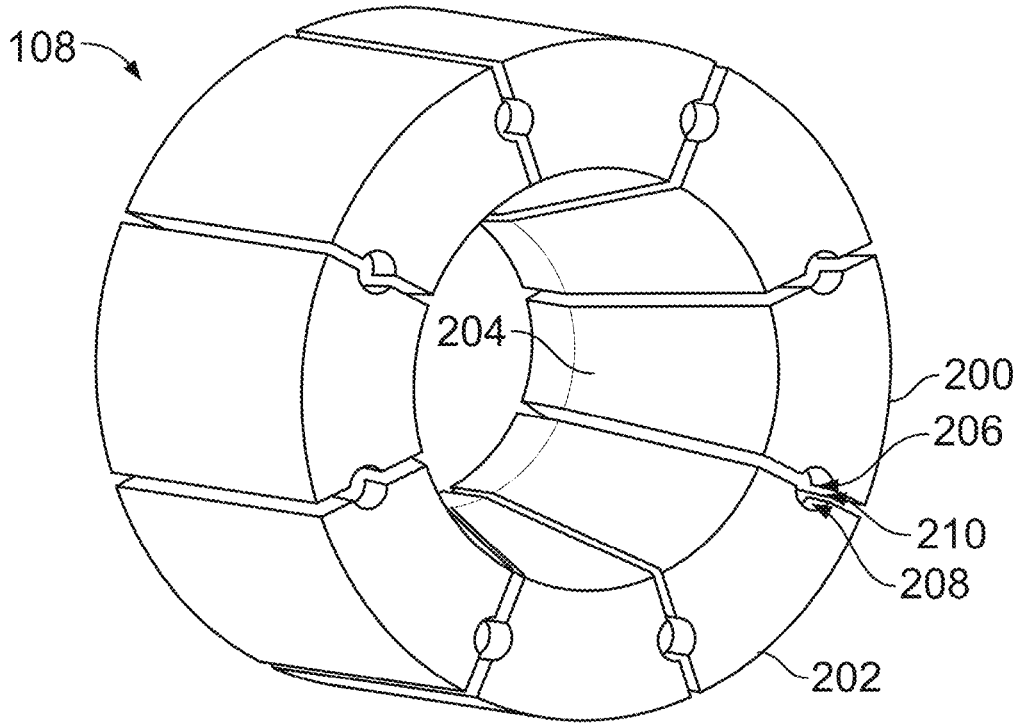
FIG. 2 illustrates a perspective view of an anchoring ring of the plug assembly of FIG. 1, according to an example implementation.

FIG. 2 illustrates a perspective view of the anchoring ring 108, according to an example implementation. As shown in FIG. 2, the anchoring ring 108 is configured as a segmented ring having a plurality of anchoring ring segments, such as anchoring ring segment 200 and anchoring ring segment 202, disposed in a circular array. The anchoring ring segments are pie-shaped and can be referred to as "sectors," each sector resembling a slice of pie.

An interior peripheral surface of the anchoring ring 108 is tapered (e.g., converges in a distal direction). For example, the anchoring ring segment 200 (and the other segments of the anchoring ring 108) has a tapered interior surface 204.

When the plug assembly 100 reaches a desired location/position within a tube, a tool is used to activate the plug assembly 100. Particularly, the tool may have a rod that is inserted into the cone 102 and applies a large force on the cone 102 in the distal direction. The cone 102 is thus driven axially or longitudinally into the anchoring ring 108 with a large force (e.g., 20,000 pound-force), and the anchoring ring 108 responsively expands due to interaction of the tapered/conical surface of the cone 102 with the interior tapered surfaces of the anchoring ring segments. As such, longitudinal or axial movement of the cone 102 in the distal direction, causes the anchoring ring segments to separate from each other and move radially outward, toward the interior peripheral surface of the tube.

Reference to "distal" and "proximal" herein is not intended to imply a specific orientation of components of the plug assembly 100 relative to any surrounding environment. Instead, these directional terms are intended to facilitate a description of the interrelationship between the several components of the plug assembly 100 and their function.

The anchoring ring segments include one or more anchoring features disposed on their exterior surfaces to facilitate affixing the segments of the anchoring ring 108 to the tube. For example, the anchoring features can be teeth, serrations, barbs, wickers, buttons, or posts, as examples.

As a particular example, as depicted in FIG. 1, the anchoring ring segments include anchoring feature(s) 112 configured as teeth with sharp edges that can be driven into an interior surface of a tube when the anchoring ring 108 is expanded radially outward during activation, creating depressions in the tube. This way the anchoring ring 108 remains locked to the tube and support is provided through the shear resistance of the high strength steel of the tube, and not just through surface friction between the anchoring ring segments and the tube. As such, the anchoring ring 108 can also be referred to as a slip ring or slip-prevention ring, and the individual anchoring ring segments (e.g., the anchoring ring segments 200, 202) can be referred to as the slips. The anchoring features are not shown in FIG. 2 to reduce visual clutter in the drawing.

Further, each segment of the anchoring ring has a feature that mates with a corresponding feature of an adjacent segment to form a receptacle. For example, the anchoring ring segment 200 has a semi-circular pocket 206 formed in an edge of the anchoring ring segment 200, and the anchoring ring segment 200 similarly has a semi-circular pocket 208 formed in a respective edge of the anchoring ring segment 202. When the anchoring ring segments 200, 202 mate, the semi-circular pockets 206, 208 form a receptacle 210 configured as a circular pocket. The use of circular pockets is not meant to be limiting, and other shapes and depths can be used for the pockets.

The support ring 106 is configured to be mounted to a proximal end face of the anchoring ring 108. Particularly, the support ring 106 has features that are received within the receptacles of the anchoring ring 108 when the support ring 106 is mounted to the anchoring ring 108.

Figure 3:
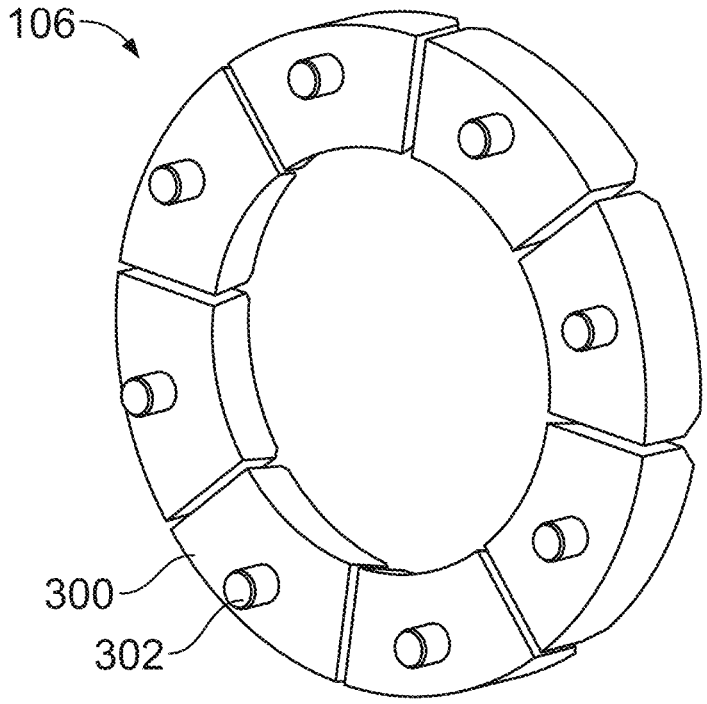
FIG. 3 illustrates a perspective view of a support ring of the plug assembly of FIG. 1, according to an example implementation.

FIG. 3 illustrates a perspective view of the support ring 106, according to an example implementation. The support ring 106 is also segmented into a plurality of support ring segments, such as support ring segment 300, disposed in a circular array. The support ring segments are also pie-shaped similar to the anchoring ring segments. The support ring segments are, however, thinner compared to the anchoring ring segments.

Each support ring segment (of at least some or a subset of the support ring segments) has a protrusion that protrudes in the distal direction to be received within a respective receptacle formed by two adjacent anchoring ring segments of the anchoring ring 108. For example, the support ring segment 300 has a protrusion 302 that can be inserted into the receptacle 210 between the anchoring ring segments 200, 202.

In the example implementation of FIG. 3, the protrusion 302 is a cylindrical post that can be inserted into the receptacle 210, which is configured as a circular pocket. However, as mentioned above, other geometric shapes and configurations can be used. For example, the protrusion can be a square, and the corresponding receptacle can have a similar shape to accommodate the protrusion. As such, the shapes of the protrusions and pockets depicted in the figures are not limiting.

As such, the support ring 106 is configured to be mounted to the proximal end face of the anchoring ring 108 such that the protrusions of the support ring segments are inserted into or received within the respective receptacles between the anchoring ring segments. Further, each support ring segment partially overlaps two adjacent anchoring ring segments.

Figure 4:
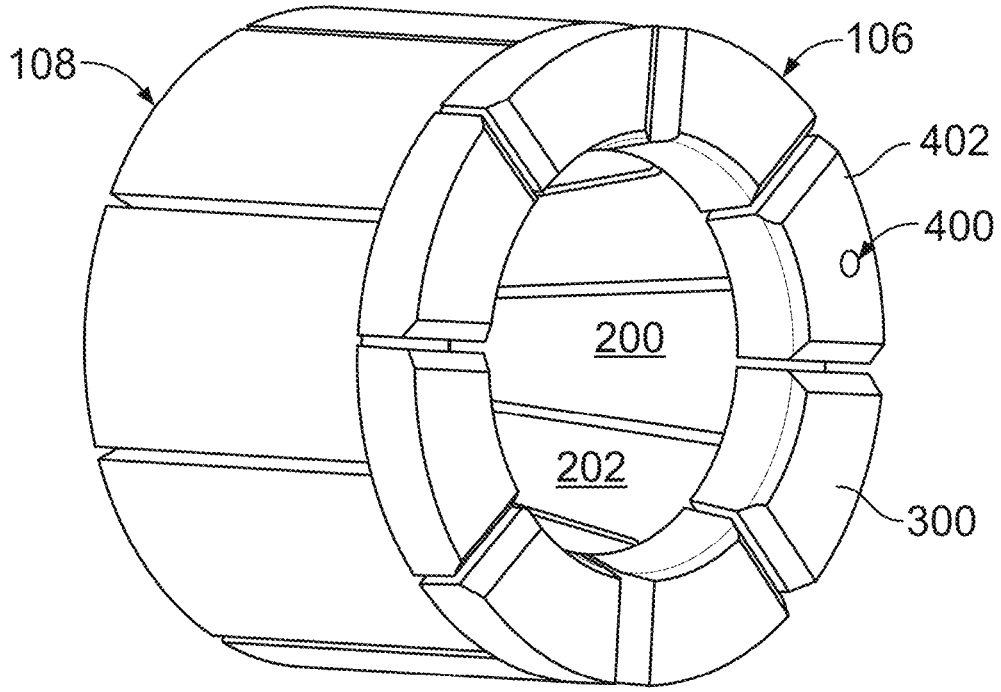
FIG. 4 illustrates a partial perspective view of the plug assembly of FIG. 1 showing the support ring of FIG. 4 mounted to the anchoring ring of FIG. 2, according to an example implementation.

FIG. 4 illustrates a partial perspective view of the plug assembly 100 showing the support ring 106 mounted to the anchoring ring 108, according to an example implementation. As depicted, each support ring segment partially overlaps two adjacent anchoring ring segments. For example, the support ring segment 300 partially overlaps the anchoring ring segment 200 and partially overlaps the anchoring ring segment 202. Referring to FIGS. 2-4 together, the protrusion 302 of the support ring segment 300 is inserted into the receptacle 210 formed between the anchoring ring segments 200, 202. In one example, the support ring 106 can be coupled or adhered to the seal 104, which is mounted to a proximal end face of the support ring 106.

Figure 5:
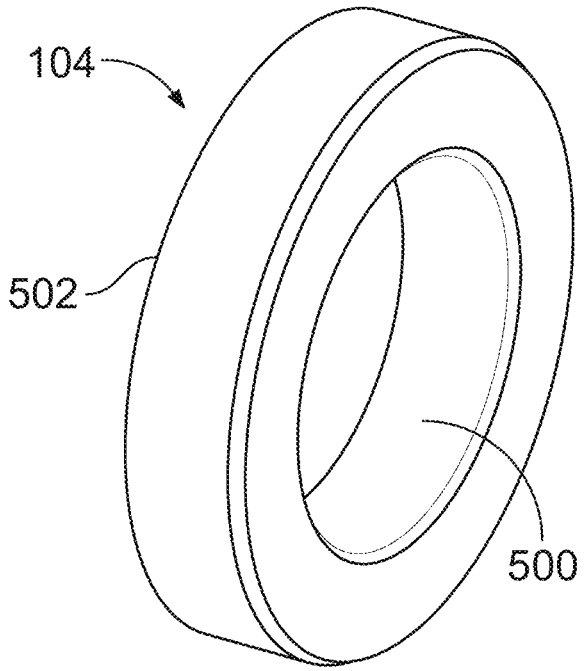
FIG. 5 illustrates a perspective view of a seal of the plug assembly of FIG. 1, according to an example implementation.

FIG. 5 illustrates a perspective view of the seal 104, according to an example implementation. The seal 104 can be configured as a radial seal made of an elastomeric material, for example. The seal 104 is ring shaped as depicted and has an interior peripheral surface 500 that interfaces with the exterior surface of the cone 102. The seal 104 also has a distal end face 502 that interfaces with the proximal end face of the support ring segments of the support ring 106.

Referring to FIGS. 4-5 together, in one example, spot bonding could be used to couple or attach the support ring 106 to the seal 104. For instance, an adhesive can be positioned at a center of each support ring segment (or at least some of the support ring segments) such as center 400 of support ring segment 402, on the side facing the seal 104. This way, when the seal 104 is mounted to the support ring 106, they are adhered or bonded to each other.

Other configurations could be used. For example, keying features can be used to mechanically lock the support ring segments of the support ring 106 to the seal 104. Other approaches are possible.

Figure 6:
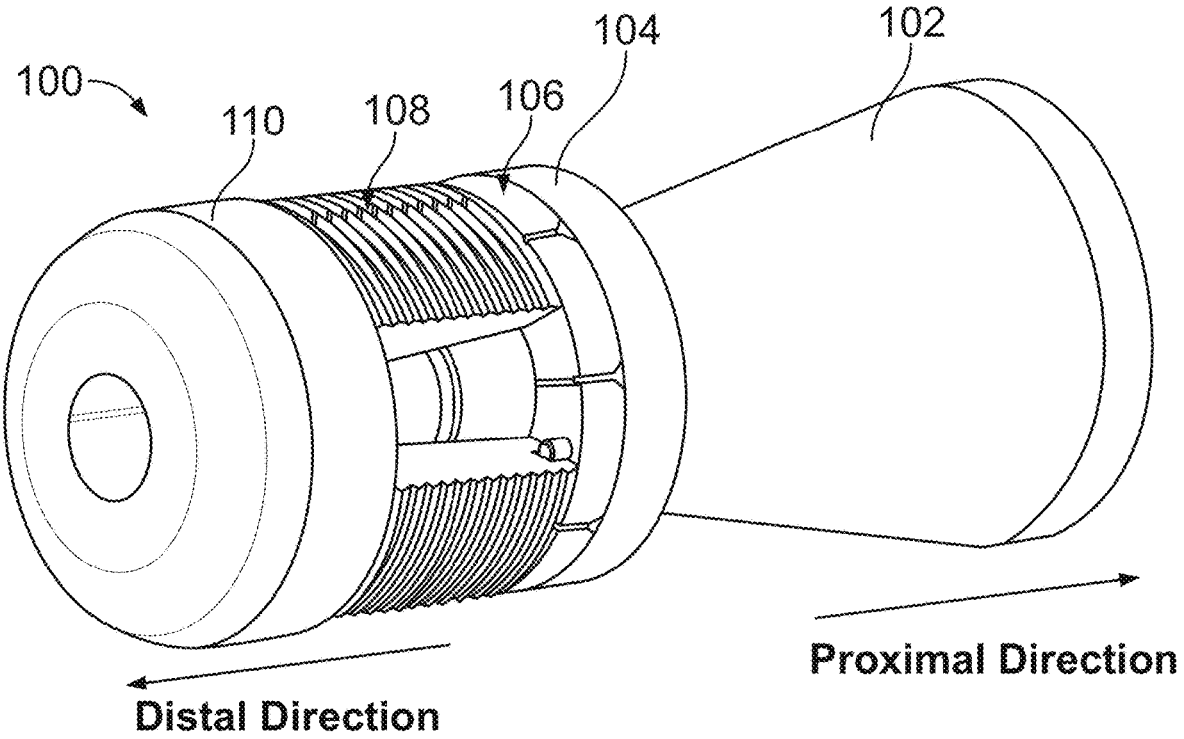
FIG. 6 illustrates a perspective view of the plug assembly of FIG. 1 during conveyance, according to an example implementation.

FIG. 6 illustrates a perspective view of the plug assembly 100 during conveyance, according to an example implementation. In FIG. 6, one of the anchoring ring segments is removed to reveal internal details of the plug assembly 100.

During conveyance (e.g., transportation of the plug assembly 100 down the tube via water pressure to a particular location), the anchoring ring segments of the anchoring ring 108 are kept together (e.g., via an adhesive or the end plate 110) in an unexpanded state. The protrusions of the support ring segments extend distally within the pockets or receptacles (i.e., the protrusions remain keyed into the pockets/receptacles) formed between the anchoring ring segments, which are retained together. As such, the support ring 106 and the seal 104 attached thereto remain locked in place, engaged, and aligned with the anchoring ring 108. This way, the likelihood of premature (prior to reaching a desired location within the tube) disassembly, dislodgement of components, or pre-setting is reduced or eliminated.

When the plug assembly 100 reaches a desired location with the tube, a tool is used to drive the cone 102 in the distal direction, thereby expanding the seal 104 to be pressed against interior surface of the tube for sealing. The conical surface of the cone 102 also interacts with the tapered interior surfaces of the anchoring ring segments, causing them to expand radially outward as the cone 102 is driven longitudinally/axially in the distal direction.

Figure 7:
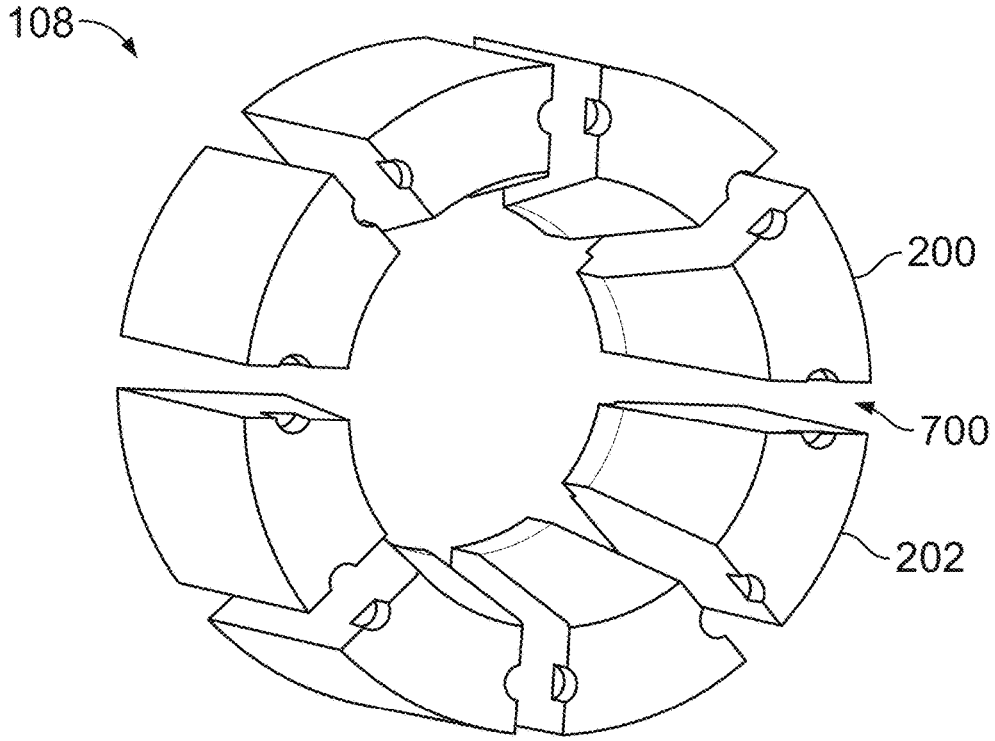
FIG. 7 illustrates a perspective view of the anchoring ring of FIG. 2 in an expanded state, according to an example implementation.

FIG. 7 illustrates a perspective view of the anchoring ring 108 in an expanded state, according to an example implementation. The support ring segments allow the anchoring ring segments to move radially outward to the expanded state shown in FIG. 7 without interference from the support ring segments. At the same time, the support ring segments bridge the respective gaps formed between the expanded anchoring ring segments.

For example, referring to FIGS. 4, 7 together, as the anchoring ring 108 expands, the anchoring ring segments 200, 202 move radially outward and apart from each other such that a gap 700 is formed therebetween. The gaps formed between the anchoring ring segments during expansion release the support ring segments and allow them to expand with the seal 104 without being influenced by movement of the anchoring ring segments.

However, although the support ring segments expand with the seal 104 (while remaining attached to the seal 104), the support ring segment 300 remains overlapped with the anchoring ring segments 200, 202, bridging the gap 700 therebetween. With this configuration, as the seal 104 is subjected to high pressure fluid during operation of the well, the seal 104 is prevented from being extruded through the gaps (e.g., the gap 700) formed between respective anchoring ring segments of the anchoring ring 108.

Figure 8:
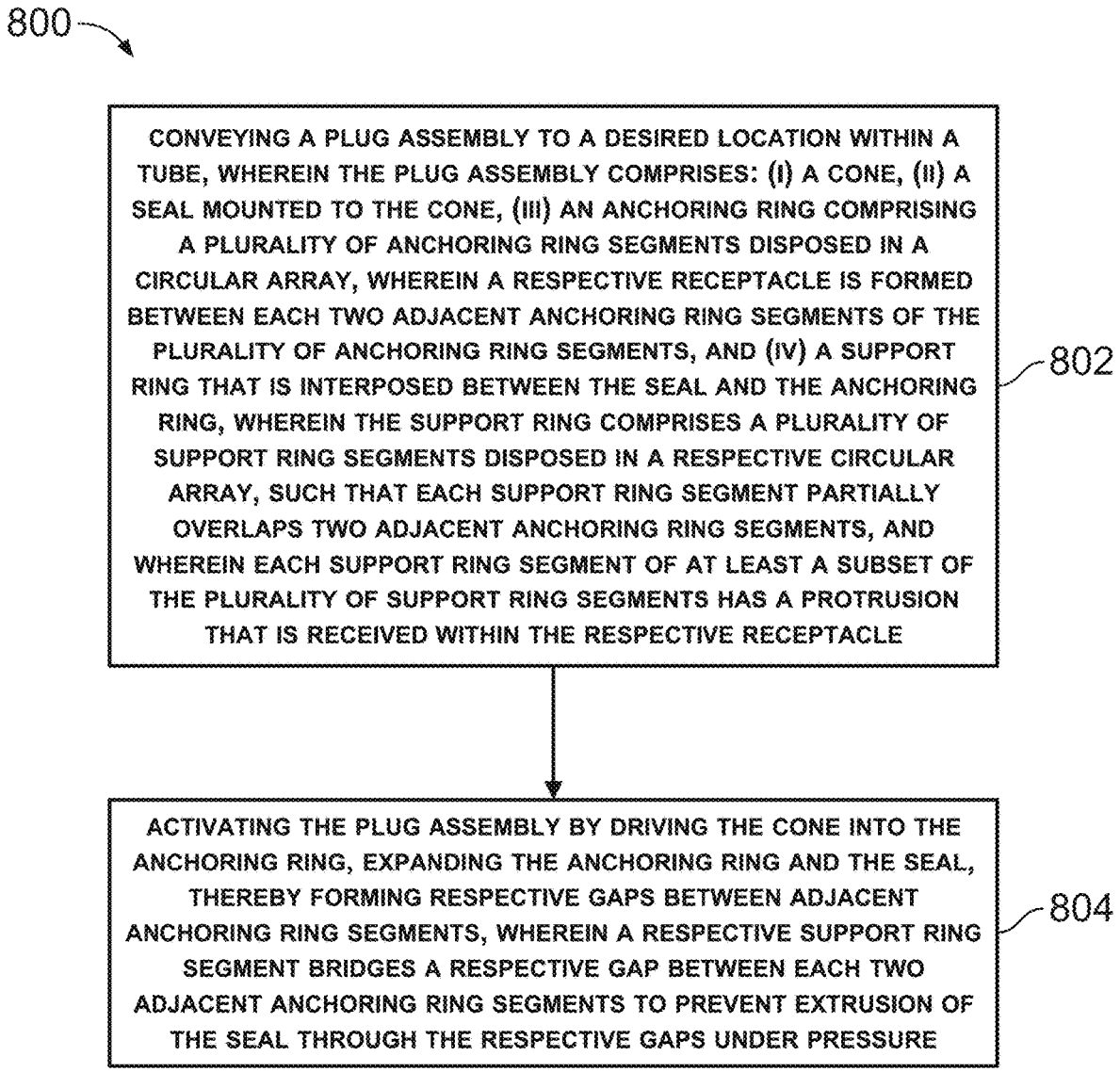
FIG. 8 is a flowchart of a method for deploying a plug assembly, according to an example implementation.

FIG. 8 is a flowchart of a method 800 for deploying the plug assembly 100 in a tube, according to an example implementation. The method 800 may include one or more operations, functions, or actions as illustrated by one or more of blocks 802-804. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 802, the method 800 includes conveying the plug assembly 100 to a desired location within a tube, wherein the plug assembly 100 comprises: (i) the cone 102, (ii) the seal 104 mounted to the cone 102, (iii) the anchoring ring 108 comprising a plurality of anchoring ring segments (e.g., the anchoring ring segments 200, 202) disposed in a circular array, wherein a respective receptacle (e.g., the receptacle 210) is formed between each two adjacent anchoring ring segments of the plurality of anchoring ring segments, and (iv) the support ring 106 that is interposed between the seal 104 and the anchoring ring 108, wherein the support ring 106 comprises a plurality of support ring segments (e.g., the support ring segment 300) disposed in a respective circular array, such that each support ring segment partially overlaps two adjacent anchoring ring segments, and wherein each support ring segment of at least a subset of the plurality of support ring segments has a protrusion (e.g., the protrusion 302) that is received within the respective receptacle.

At block 804, the method 800 includes activating the plug assembly 100 by driving the cone 102 into the anchoring ring 108, expanding the anchoring ring 108 and the seal 104, thereby forming respective gaps (e.g., the gap 700) between adjacent anchoring ring segments, wherein a respective support ring segment bridges a respective gap between each two adjacent anchoring ring segments to prevent extrusion of the seal 104 through the respective gaps under pressure.

The method 800 can further include any of the other steps or operations described throughout herein.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" or "about" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

Embodiments of the present disclosure can thus relate to one of the enumerated example embodiments (EEEs) listed below.

EEE 1 is a plug assembly comprising: a cone; a seal mounted to the cone; an anchoring ring comprising a plurality of anchoring ring segments disposed in a circular array, wherein a respective receptacle is formed between each two adjacent anchoring ring segments of the plurality of anchoring ring segments; and a support ring that is interposed between the seal and the anchoring ring, wherein the support ring comprises a plurality of support ring segments disposed in a respective circular array, such that each support ring segment partially overlaps two adjacent anchoring ring segments, and wherein each support ring segment of at least a subset of the plurality of support ring segments has a protrusion that is received within the respective receptacle.

EEE 2 is the plug assembly of EEE 1, wherein during activation of the plug assembly, the cone is driven into the anchoring ring, expanding the anchoring ring and the seal, thereby forming respective gaps between adjacent anchoring ring segments, and wherein a respective support ring segment bridges a respective gap between each two adjacent anchoring ring segments to prevent extrusion of the seal through the respective gaps under pressure.

EEE 3 is the plug assembly of EEE 2, wherein the cone comprises a conical surface configured to interact with respective tapered interior surfaces of respective anchoring ring segments of the anchoring ring, thereby causing the anchoring ring to expand upon axial movement of the cone.

EEE 4 is the plug assembly of any of EEEs 1-3, wherein respective anchoring ring segments of the plurality of anchoring ring segments are pie shaped.

EEE 5 is the plug assembly of any of EEEs 1-4, wherein respective support ring segments of the plurality of support ring segments are pie shaped.

EEE 6 is the plug assembly of any of EEEs 1-5, wherein each anchoring ring segment has a feature formed in an edge thereof, such that when the feature of an anchoring ring segment mates with a respective feature of an adjacent anchoring ring segment, the feature and the respective feature form the respective receptacle.

EEE 7 is the plug assembly of EEE 6, wherein the feature comprises a semi-circular pocket, and wherein the respective receptacle is a circular pocket.

EEE 8 is the plug assembly of EEE 7, wherein the protrusion is a cylindrical post.

EEE 9 is the plug assembly of any of EEEs 1-8, wherein the anchoring ring comprises one or more anchoring features disposed on an exterior surface of the plurality of anchoring ring segments to facilitate affixing the anchoring ring to a tube in which the plug assembly is deployed.

EEE 10 is the plug assembly of EEE 9, wherein the one or more anchoring features comprise teeth, serrations, barbs, wickers, buttons, or posts.

EEE 11 is the plug assembly of any of EEEs 1-10, wherein the support ring is attached to the seal such that, as the seal expands, the support ring expands therewith, while each support ring segment remains overlapped with each two adjacent anchoring ring segments to bridge a respective gap formed therebetween.

EEE 12 is the plug assembly of EEE 11, wherein each support ring segment is spot bonded to the seal.

EEE 13 is the plug assembly of EEE 11, wherein respective keying features in the support ring and the seal are used to mechanically lock the support ring to the seal.

EEE 14 is the plug assembly of any of EEEs 1-13, further comprising: an end plate mounted at a distal end of the anchoring ring to keep the plurality of anchoring ring segments together during conveyance of the plug assembly, wherein the end plate is configured as a frangible retainer that fractures at a defined load to allow the anchoring ring segments to expand during activation of the plug assembly.

EEE 15 is a method comprising: conveying a plug assembly to a desired location within a tube, wherein the plug assembly comprises: (i) a cone, (ii) a seal mounted to the cone, (iii) an anchoring ring comprising a plurality of anchoring ring segments disposed in a circular array, wherein a respective receptacle is formed between each two adjacent anchoring ring segments of the plurality of anchoring ring segments, and (iv) a support ring that is interposed between the seal and the anchoring ring, wherein the support ring comprises a plurality of support ring segments disposed in a respective circular array, such that each support ring segment partially overlaps two adjacent anchoring ring segments, and wherein each support ring segment of at least a subset of the plurality of support ring segments has a protrusion that is received within the respective receptacle; and activating the plug assembly by driving the cone into the anchoring ring, expanding the anchoring ring and the seal, thereby forming respective gaps between adjacent anchoring ring segments, wherein a respective support ring segment bridges a respective gap between each two adjacent anchoring ring segments to prevent extrusion of the seal through the respective gaps under pressure.

EEE 16 is the method of EEE 15, wherein the cone comprises a conical surface, wherein respective anchoring ring segments of the anchoring ring comprise respective tapered interior surfaces, and wherein activating the plug assembly by driving the cone into the anchoring ring comprises: causing the conical surface of the cone to interact with the respective tapered interior surfaces to expand the anchoring ring upon axial movement of the cone.

EEE 17 is the method of any of EEEs 15-16, wherein each anchoring ring segment has a feature formed in an edge thereof, and wherein the method further comprises: mating the feature of an anchoring ring segment with a respective feature of an adjacent anchoring ring segment to form the respective receptacle.

EEE 18 is the method of EEE 17, wherein the feature comprises a semi-circular pocket, and wherein mating the feature of the anchoring ring segment with the respective feature of the adjacent anchoring ring segment comprises forming a circular pocket, wherein the protrusion is a cylindrical post, and wherein the method further comprises: inserting the circular post into the circular pocket.

EEE 19 is the method of any of EEEs 15-18, further comprising: attaching the support ring to the seal such that, as the seal expands, the support ring expands therewith, while each support ring segment remains overlapped with each two adjacent anchoring ring segments to bridge a respective gap formed therebetween.

EEE 20 is the method of EEE 19, further comprising: mounting an end plate at a distal end of the anchoring ring to keep the plurality of anchoring ring segments together during conveyance of the plug assembly, wherein the end plate is configured as a frangible retainer, and wherein activating the plug assembly by driving the cone into the anchoring ring causes the end plate to fracture and allow the plurality of anchoring ring segments to expand.

What is claimed is:

1. A plug assembly comprising:

a cone;

a seal mounted to the cone;

an anchoring ring comprising a plurality of anchoring ring segments disposed in a circular array, wherein a respective receptacle is formed between each two adjacent anchoring ring segments of the plurality of anchoring ring segments; and a support ring that is interposed between the seal and the anchoring ring, wherein the support ring is segmented circumferentially such that the support ring comprises a plurality of support ring segments disposed in a respective circular array, wherein each support ring segment partially overlaps two adjacent anchoring ring segments, and wherein each support ring segment of at least a subset of the plurality of support ring segments has a protrusion that is received within the respective receptacle.

2. The plug assembly of claim 1, wherein during activation of the plug assembly, the cone is driven into the anchoring ring, expanding the anchoring ring and the seal, thereby forming respective gaps between adjacent anchoring ring segments, and wherein a respective support ring segment bridges a respective gap between each pair of adjacent anchoring ring segments to prevent extrusion of the seal through the respective gaps under pressure.

3. The plug assembly of claim 2, wherein the cone comprises a conical surface configured to interact with respective tapered interior surfaces of respective anchoring ring segments of the anchoring ring, thereby causing the anchoring ring to expand upon axial movement of the cone.

4. The plug assembly of claim 1, wherein respective anchoring ring segments of the plurality of anchoring ring segments are pie shaped.

5. The plug assembly of claim 1, wherein respective support ring segments of the plurality of support ring segments are pie shaped.

6. The plug assembly of claim 1, wherein each anchoring ring segment has a feature formed in an edge thereof, such that when the feature of an anchoring ring segment mates with a respective feature of an adjacent anchoring ring segment, the feature and the respective feature form the respective receptacle.

7. The plug assembly of claim 6, wherein the feature comprises a semi-circular pocket, and wherein the respective receptacle is a circular pocket.

8. The plug assembly of claim 7, wherein the protrusion is a cylindrical post.

9. The plug assembly of claim 1, wherein the anchoring ring comprises one or more anchoring features disposed on an exterior surface of the plurality of anchoring ring segments.

10. The plug assembly of claim 9, wherein the one or more anchoring features comprise teeth, serrations, barbs, wickers, buttons, or posts.

11. The plug assembly of claim 1, wherein the support ring is attached to the seal such that, as the seal expands, the support ring expands therewith, while each support ring segment remains overlapped with each two adjacent anchoring ring segments to bridge a respective gap formed therebetween.

12. The plug assembly of claim 11, wherein each support ring segment is spot bonded to the seal.

13. The plug assembly of claim 11, wherein respective features in the support ring and the seal are used to mechanically lock the support ring to the seal.

14. The plug assembly of claim 1, further comprising:

an end plate mounted at a distal end of the anchoring ring to keep the plurality of anchoring ring segments together during conveyance of the plug assembly, wherein the end plate is configured as a frangible retainer that fractures at a defined load to allow the anchoring ring segments to expand during activation of the plug assembly.

15. A method comprising:

conveying a plug assembly to a desired location within a tube, wherein the plug assembly comprises: (i) a cone, (ii) a seal mounted to the cone, (iii) an anchoring ring comprising a plurality of anchoring ring segments disposed in a circular array, wherein a respective receptacle is formed between each two adjacent anchoring ring segments of the plurality of anchoring ring segments, and (iv) a support ring that is interposed between the seal and the anchoring ring, wherein the support ring is segmented circumferentially such that the support ring comprises a plurality of support ring segments disposed in a respective circular array, wherein each support ring segment partially overlaps two adjacent anchoring ring segments, and wherein each support ring segment of at least a subset of the plurality of support ring segments has a protrusion that is received within the respective receptacle; and activating the plug assembly by driving the cone into the anchoring ring, expanding the anchoring ring and the seal, thereby forming respective gaps between adjacent anchoring ring segments, wherein a respective support ring segment bridges a respective gap between each two adjacent anchoring ring segments to prevent extrusion of the seal through the respective gaps under pressure.

16. The method of claim 15, wherein the cone comprises a conical surface, wherein respective anchoring ring segments of the anchoring ring comprise respective tapered interior surfaces, and wherein activating the plug assembly by driving the cone into the anchoring ring comprises:

causing the conical surface of the cone to interact with the respective tapered interior surfaces to expand the anchoring ring upon axial movement of the cone.

17. The method of claim 15, wherein each anchoring ring segment has a feature formed in an edge thereof, and wherein the method further comprises:

mating the feature of an anchoring ring segment with a respective feature of an adjacent anchoring ring segment to form the respective receptacle.

18. The method of claim 17, wherein the feature comprises a semi-circular pocket, and wherein mating the feature of the anchoring ring segment with the respective feature of the adjacent anchoring ring segment comprises forming a circular pocket, wherein the protrusion is a cylindrical post, and wherein the method further comprises:

inserting the circular post into the circular pocket.

19. The method of claim 15, further comprising:

attaching the support ring to the seal such that, as the seal expands, the support ring expands therewith, while each support ring segment remains overlapped with each two adjacent anchoring ring segments to bridge a respective gap formed therebetween.

20. The method of claim 19, further comprising:

mounting an end plate at a distal end of the anchoring ring to keep the plurality of anchoring ring segments together during conveyance of the plug assembly, wherein the end plate is configured as a frangible retainer, and wherein activating the plug assembly by driving the cone into the anchoring ring causes the end plate to fracture and allow the plurality of anchoring ring segments to expand.

* * * * *